United States Patent [19]

Norris

[11] 4,157,683

[45] Jun. 12, 1979

[54] PRINTING SYSTEM

[75] Inventor: Alan H. Norris, Rome, Ga.

[73] Assignee: WWG Industries, Inc., Rome, Ga.

[21] Appl. No.: 609,938

[22] Filed: Sep. 3, 1975

[51] Int. Cl.[2] ..... B41F 1/10; B41F 15/10

[52] U.S. Cl. ..... 101/211; 101/115; 101/171; 101/198; 101/126; 226/123

[58] Field of Search ..... 226/123; 118/46, 212, 118/213; 8/149, 151; 68/200, 203, 205 R; 101/211, 114, 115, 129, 126, 171, 196, 197, 198-201; 427/282, 288

[56] References Cited

U.S. PATENT DOCUMENTS

| | | | |
|---|---|---|---|
| 1,228,529 | 6/1917 | Campbell | 101/198 |
| 3,129,442 | 4/1964 | Leckie | 101/126 |
| 3,164,088 | 1/1965 | Vechot | 101/171 |
| 3,276,650 | 10/1966 | Larkin | 226/123 |
| 3,335,658 | 8/1967 | Vschmann | 101/171 |
| 3,921,519 | 11/1975 | Zimmer | 101/116 |
| 3,926,111 | 12/1975 | Bohm | 101/116 |

*Primary Examiner*—William Pieprz

*Attorney, Agent, or Firm*—Beveridge, DeGrandi, Kline & Lunsford

[57] ABSTRACT

A method of printing a multicolor design on a long, continuous web or carpet in a machine having uniformly spaced printing stations and apparatus for longitudinally advancing the carpet in steps between printing operations. Two or more stations adjacent each other are used for each color to appear in the design being printed. The carpet movement increment distances are selected as a function of total number of colors n, total number of stations P and the number of stations per color N to increase production. In the preferred embodiment a repeated sequence of distances $D_1$ and $D_2$ are selected so that $D_1+D_2=2N$, $D_1$ and $D_2$ each being odd integral numbers of pattern repeat lengths.

1 Claim, 4 Drawing Figures

PRINTING SYSTEM

This invention relates to a method of printing and, more specifically, a method of printing a repetitive multicolor pattern.

The method of the present invention involves printing on a material such as carpet, the printing operation to be employed constituting that which is known as stencil printing. It is well known in the prior art to use stencil printing techniques on thick fabrics such as carpet and apparatus for accomplishing this process is now regarded as standard and conventional in the field. Examples of such apparatus are shown in U.S. Pat. No. 3,129,442, Leckie; U.S. Pat. No. 3,140,028, Leckie; U.S. Pat. No. 3,302,564, Wilford; and U.S. Pat. No. 3,418,931, Wilford. The present invention contemplates using apparatus which is of the general type disclosed in these patents.

As described therein, an elongated web of carpet material is preliminarily treated, as by brushing and cleaning, and is then delivered to the printing part of the machine in which there are several printing stations, typically eight stations in the above-mentioned patents. Each printing station includes a color box and means for engaging the carpet and assisting with the flow of coloring material through a portion of the carpet. A pattern to be printed on a carpet often is formed by relatively large areas of different colors, as many as eight such colors. In order to print such a carpet there can be eight printing stations, one for each color. The elongated web of carpet fabric is moved stepwise through the machine, the conventional technique being to move the carpet in steps which are equal in length to the length of the pattern, this being conventionally referred to as the repeat length of the pattern. As each pattern section of the carpet reaches a color station, a portion of the design, in the specific color being handled by that station, is printed on the carpet so that after each section of the carpet has passed through the entire machine, all of the colors applied thereby have been placed in their appropriate locations on the carpet. Such locations are, of course, determined by the designs defined by the opaque and color transmitting portions of the stencils in the color boxes.

Because of the fact that supporting structure for each color box must be provided, the entire space occupied by each color box in the direction of longitudinal motion of the carpet is longer than a repeat length of the pattern. Thus, the boxes are not normally placed adjacent each other but are, instead, spaced apart by a distance equal to the pattern repeat length, measured between the leading and trailing edges of successive color boxes.

After the carpet has passed through the portion of the machine which supports the uniformly spaced color boxes, the carpet is steamed and further processed to fix the color and wind up the printed carpet.

The apparatus thus described forms no part of the present invention and no further detailed description of the machinery itself will be included herein, reference being made to the above patents and similar machine for further details thereof.

In a machine of this type, production of carpet is rather strictly defined by characteristics of the machine which cannot be significantly modified. The velocity of the carpet in its incremental stepwise motion between printing operations is limited by the absolute necessity for accurate starting and stopping so that each printing operation is precisely registered with the repeat length regions on the carpet to avoid overlapping of colors in an undesirable fashion in the pattern. The speed of the printing operation itself is also limited by the rather sensitive requirements of the mechanisms used to deliver the coloring fluid through the color boxes onto the carpet and the apparatus which holds the carpet in the proper position during the printing operation. These limitations and environmental conditions of the machine are similarly described in the above-mentioned patents. Thus, although it is highly desirable to increase the production capacity of a given carpet machine, such increase in production capacity cannot readily be attained by such simple expedients as increasing speeds.

A method has now been discovered for providing the printing of a repetitive multicolor pattern on a long continuous fabric web, such as a carpet, using a printing apparatus of the above-described type. The method of the present invention is highly flexible and permits the printing apparatus to be used with a variety of numbers of colors, pattern arrangements, and the like. Moreover, the present method greatly increases the productive capacity of a given carpet machine.

Briefly described, the method involves using a printing apparatus of the above-described type by selecting the total number of colors to be printed in the pattern, the total number of printing stations to be used, and the number of stations to be used for each color so that a plurality of stations is used for each color, assigning the colors to the printing stations so that the arrangement of colors longitudinally along the printing apparatus is in a predetermined repetitive sequence, moving the fabric web in steps of predetermined lengths through the printing apparatus and stopping and printing on the web between movements, each movement being for a distance equal to an integral number of repeat lengths with the length of each movement and the sequence of movement lengths being a function of the number of colors, the total number of stations, the number of stations per color and the predetermined sequence of colors assigned to the printing stations so that the production capacity of the printing apparatus is significantly increased.

In a particularly advantageous embodiment of the invention, the arrangement of colors is such that colors are assigned to the printing stations so that all stations for printing the same color follow one another in sequence. This method includes selecting the total number P of printing stations and the number N of stations for printing each color so that N is equal to or less than the ratio P/n, where n is the number of different colors to be printed in the pattern, and moving the fabric longitudinally for a distance $D_1$ between two successive printing operations and for a distance $D_2$ between the next two successive printing operations where $D_1$ and $D_2$ are each equal to integral odd numbers of pattern repeat lengths and the sum $D_1+D_2=2N$.

In order that the manner in which the foregoing and other objects are attained in accordance with the invention can be understood in detail, particularly advantageous embodiments thereof will be described with reference to the accompanying drawings, which form a part of this specification, and wherein.

Figure 1:
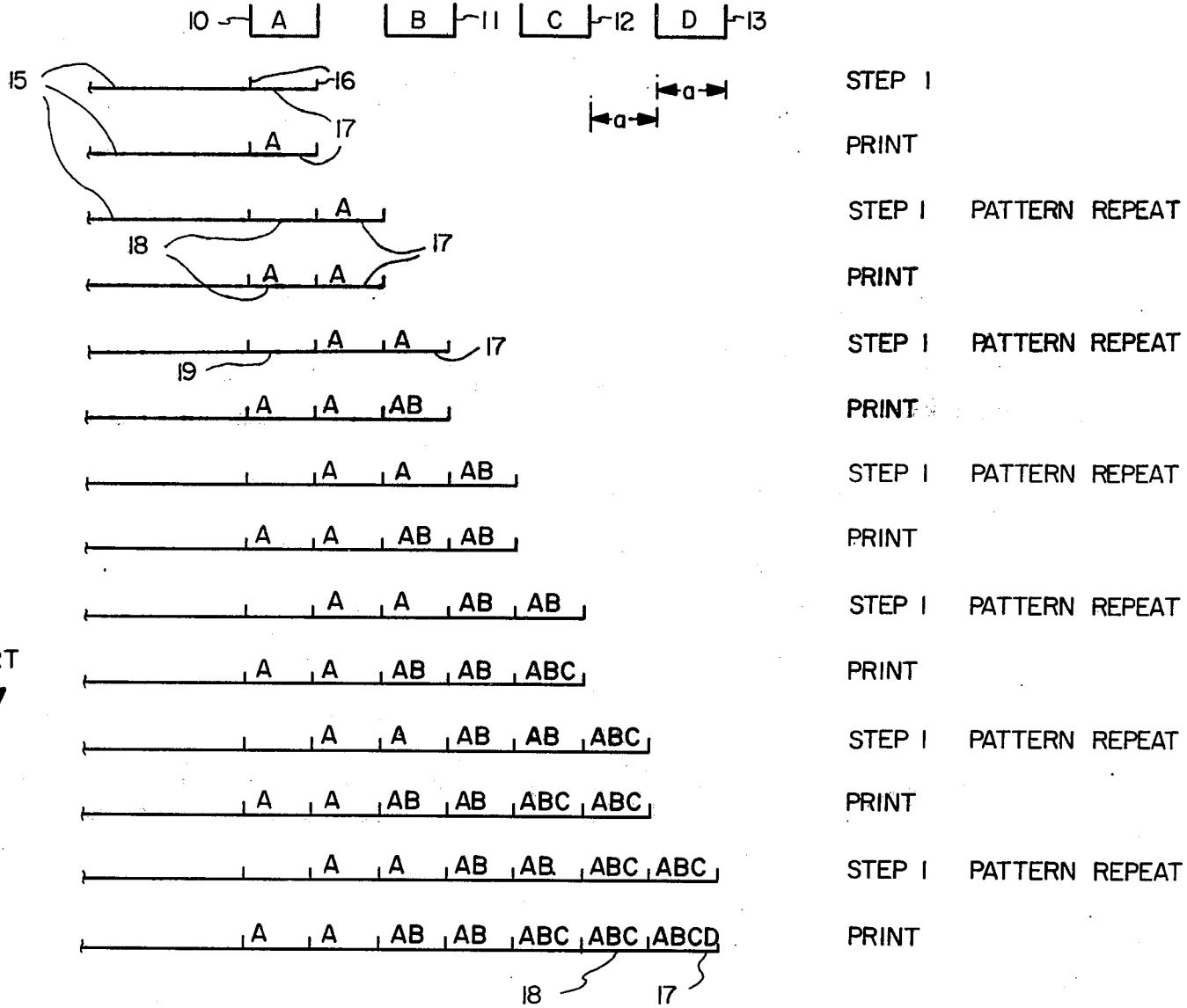
PRIOR ART FIG. 1
FIG. 1 is a sequence chart schematically showing the sequence of steps of printing methods in accordance with the prior art.

As indicated in U.S. Pat. No. 3,302,564, previously mentioned, it is conventional to use a number of stations, one for each color, in a printing apparatus of the conventional type. FIG. 1 illustrates a simplified arrangement in which only four stations, one for each color is used. The use of four stations, rather than eight, is illustrated for simplicity, but the principle of operation is identical to that for a larger number of colors. As shown in FIG. 1, there is no effort to illustrate the details of the apparatus, only the essential components and their general relationship being illustrated. As shown in FIG. 1, there are four color stations 10, 11, 12 and 13 which have been assigned the tasks of printing colors A, B, C and D, respectively. Each color box, or printing station, has an effective printing length, which length is identified in FIG. 1 by the dimension a. Also, the separation between the effective portions of the printing stations is the same dimension a.

A length of carpet is delivered through the apparatus to the region of the printing station, the carpet fabric being identified as 15 in FIG. 1. A plurality of sequential positions of this same piece of fabric are shown in the vertical array of FIG. 1 under the printing stations. These sequential positions are, of course, schematic and do not indicate any vertical motion of the carpet itself. Instead, they simply indicate the time sequence of events as the fabric is incrementally moved through the machine. The first step involves delivering a portion of the carpet to a location in which it can be printed by station A. While this portion is illustrated as being the leading edge of the carpet, it can be considered as any segment of a continuous length being fed through the machine, the assumption being made that more printed carpet extends to the right of the portion shown. That portion of the carpet has simply been omitted for simplicity.

On the fabric itself, small marks 16 have been shown in FIG. 1 for the purpose of illustrating the location of the beginning and end of each repeat length of the pattern. Obviously, such marks do not necessarily appear on the carpet, but are provided in the drawing for clarification. Each pair of marks thus defines a repeat zone or repeat length in the longitudinal direction of motion of the carpet.

In the first step, a first repeat length 17 is moved to a position adjacent printing station 10. In the second step of the operation, the fabric is stopped and station 10 is actuated to print color A on portion 17 of the carpet. In the third step the fabric is incrementally moved so that portion 17 lies between stations 10 and 11 and a portion 18 is delivered to a position adjacent station 10 so that, in step 4, color A is printed on zone 18. In step 5, the fabric is again incrementally moved by the same repeat length distance so that portion 17 lies adjacent printing station 11 and a portion 19 is adjacent station 10. Then, the fabric is again stopped and printing stations 10 and 11 are actuated to print color A in zone 19 and color B in zone 17.

This sequence of steps is repeated with each incremental motion being equal to one repeat length of the pattern until zone 17, as shown in the bottom line of FIG. 1, is finally printed with all four of the colors which are to appear in each repeat length of the carpet. Obviously, on the next step, zone 18 will be printed with the last color, and so forth.

This sequence illustrates the printing method which has been conventionally employed.

Figure 2:
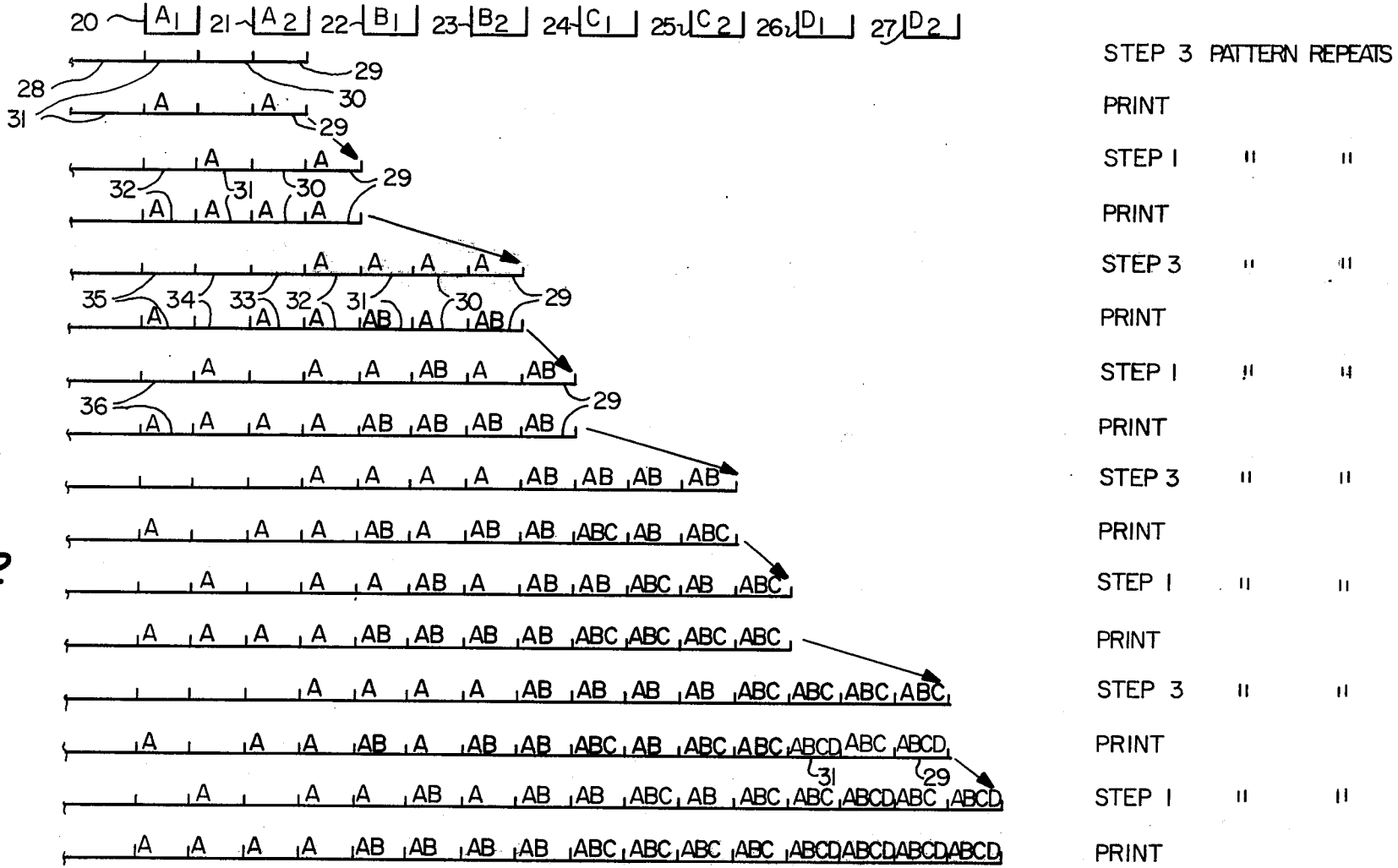
FIG. 2 is a sequence chart schematically showing application of the method of the present invention to a printing apparatus of a standard type.

In accordance with the present invention, as illustrated in FIG. 2, the number of printing stations employed to print each color is doubled, as compared with the prior art system of FIG. 1, so that two stations are used for each color. Thus, the apparatus has stations 20 and 21 which are assigned color A, stations 22 and 23 for color B, stations 24 and 25 for color C, and stations 26 and 27 for color D. In this arrangement, the carpet web 28 is advanced into the machine until the first three repeat pattern zones 29, 30 and 31, respectively, are in a position such that zone 29 is adjacent station 21, zone 30 lies between stations 20 and 21 and zone 31 lies adjacent station 20. In step 2 of the process, stations 20 and 21 are actuated to print color A, causing the portion of the design having this color to be printed with color A in regions 29 and 31. Note that the advance of carpet 28 to this position involves advancing the carpet a distance equal to three pattern repeat lengths.

The carpet is then advanced one repeat length, placing zone 29 in a position between stations 21 and 22, zone 31 in a position between stations 20 and 21, and zones 30 and 32 adjacent stations 21 and 20, respectively. These stations are then actuated to print color A, resulting in that color being printed in all of zones 29–32.

The carpet is then advanced a distance equal to three pattern repeats, moving the four zones which have been printed with color A to positions adjacent to, or between, the next succeeding station and advancing zones 33, 34 and 35 to positions initially occupied by zones 29, 30 and 31, respectively. Stations 20, 21, 22 and 23 are then actuated to print color B in zones 29 and 31 and color A in zones 33 and 35. The next advance is one repeat length so that the next printing results in color A being printed in all of zones 32–36 and both of colors A and B being printed in zones 29–32.

This sequence of steps is then repeated with the carpet being advanced distances equal to three and one repeat lengths, alternately, so that after the fourteenth operation, zones 29 and 31 are the first zones to be printed with all four colors which are to exist in the specific pattern.

A significant aspect of the method as represented by the example of FIG. 2 is that the colors are assigned to the printing stations so that the arrangement of colors longitudinally along the printing apparatus is in a predetermined sequence, this sequence including the arrangement of all stations for printing the same color following one another in sequence. A further significant aspect of the method is that the distances through which the carpet is moved in each incremental movement is equal to an integral number of repeat lengths, the length of each movement and the sequence of movement lengths being a function of the number of colors, the total number of stations, the number of stations per color and the predetermined sequence of colors assigned to the printing station. It will be observed that after the fourteenth step in the operation of the apparatus of FIG. 2, two repeat zones of the carpet have been printed with all four of the colors assigned to this particular exemplary pattern. It can further be observed that, in the prior art example of FIG. 1, after the fourteenth operation only one repeat length zone has been printed with all four colors. Thus, the actual productive output of the machine in the same number of sequence steps is approximately doubled. It will further be observed that approximately the same amount of time is required to produce this doubled production, the actual time being decreased only to the extent that some additional time is required to move the carpet three repeat lengths in a single increment as compared with moving the carpet one repeat length in a single increment as in FIG. 1. However, because of the fact that the time required to move the carpet three repeat lengths as compared with one repeat length is extremely small when compared with the total time required to increment and print the carpet in any given cycle, this detracts only in a minimal fashion from the total productive capacity of the machine. Thus, while the productive capacity is not quite doubled, it is, indeed, very close to being twice that accomplished by prior art methods.

Figure 3:
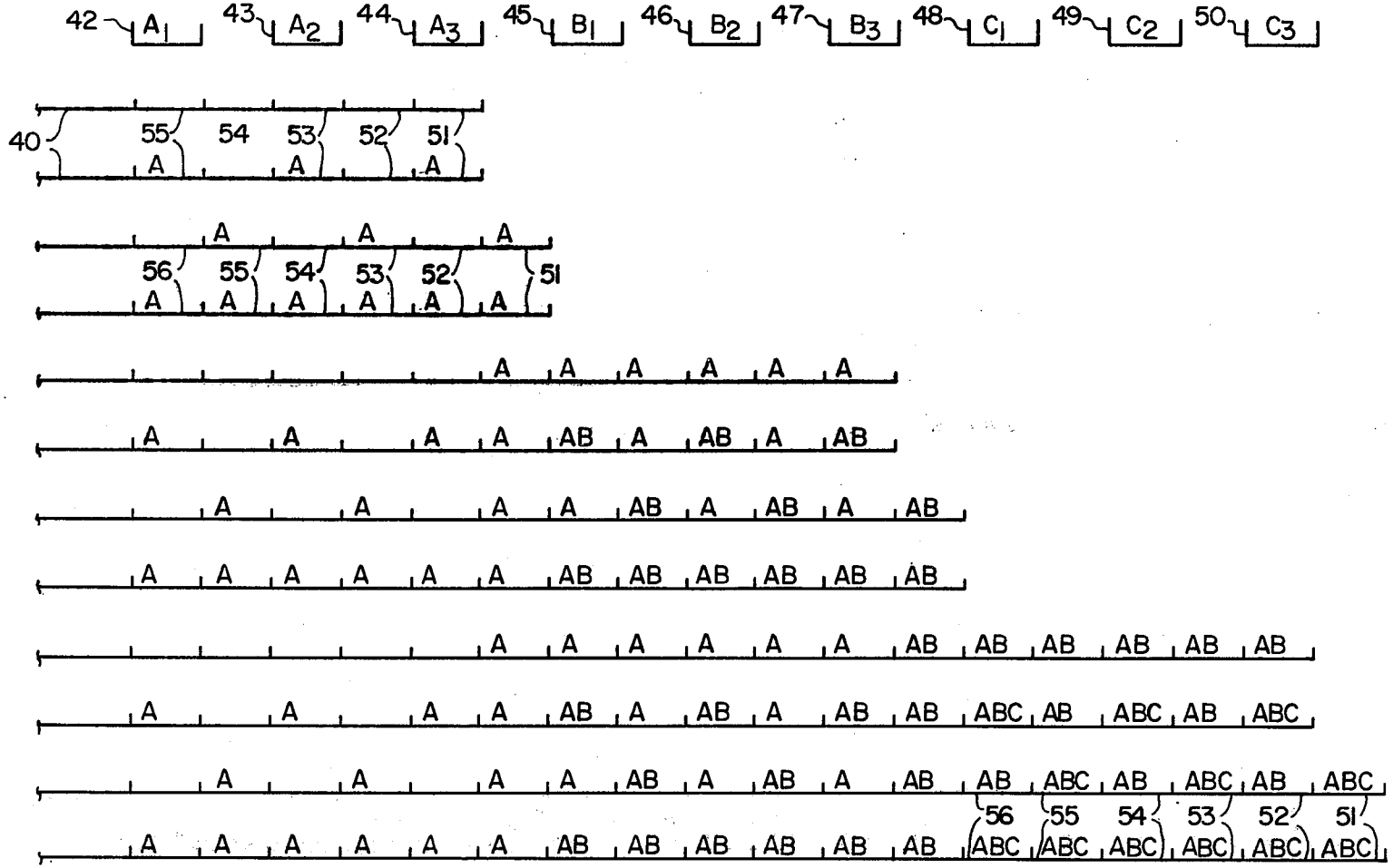
FIG. 3 is a sequence chart schematically showing the steps of a method according to the present invention using a different number of couplers and stations per color of the embodiment of FIG. 2.

A further example of a method of printing in accordance with the invention is shown in FIG. 3. In this example, the carpet 40 is to be printed with three colors and the total number of printing stations to be used is nine, with three printing stations being assigned to each color. Thus, stations 42, 43 and 44 are assigned the task of printing color A, stations 45, 46 and 47 are to print color B, and stations 48, 49 and 50 are to print color C. it should be noted that the designation $A_1$, $A_2$, etc., is not intended to indicate different colors or shades of color A, but simply the fact that three stations are employed for color A.

In the method employed with this number of colors and stations the carpet can be advanced in a sequence in which the carpet is first moved an incremental distance $D_1$ equal to five repeat lengths, and is then moved a distance $D_2$ equal to one repeat length. This sequence of movements between printing steps is then repeated until all of the carpet is printed. Thus, in the first movement, carpet 40 is moved so that the beginning of the portion under consideration is under station 44, this portion being identified as repeat length zone 51. The second portion 52 lies between stations 43 and 44, the third zone 53 lies adjacent station 43, zone 54 lies between stations 42 and 43, and zone 55 lies adjacent station 42. The printing operation is then accomplished, printing color A in zones 51, 53 and 55.

The carpet is then advanced one repeat length and the printing operation is repeated, printing color A in zones 52, 54 and 56. At this point, the first five zones have all been printed with color A so the carpet is advanced five repeat lengths, moving the next five unprinted portions adjacent the color A printing stations and moving the first five adjacent the color B printing stations. This process is repeated resulting in the first six zones being printed with all three colors after twelve steps of the method.

Figure 4:
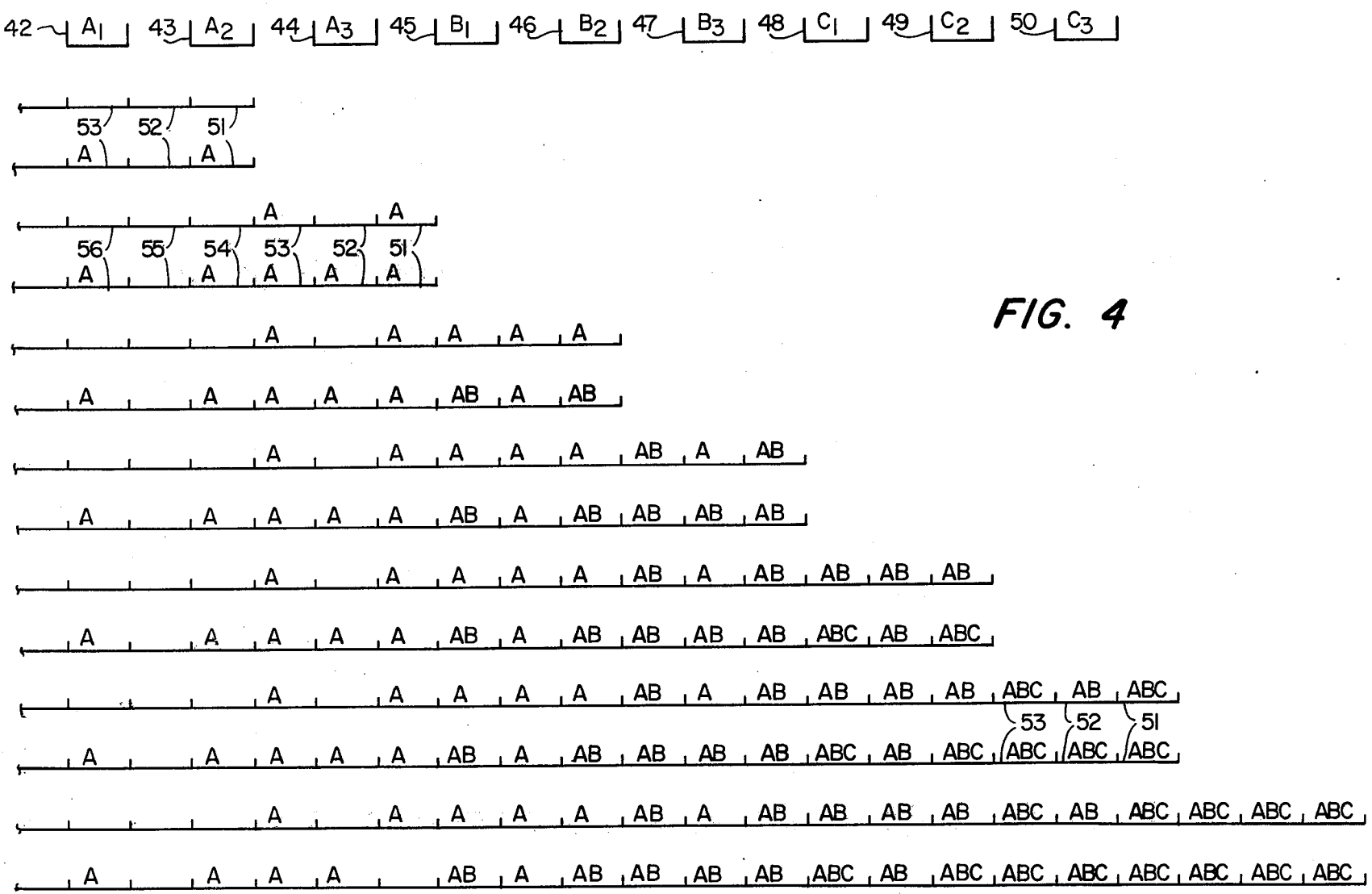
FIG. 4 is a sequence chart showing a different sequencing process from the embodiment of FIG. 3 with the same number of colors and stations per color as in FIG. 3.

FIG. 4 illustrates an alternative sequence of steps which can be used to perform the same printing operation as illustrated in connection with FIG. 3. As indicated therein, a different pair of distances can be used with the same number of colors and printing stations, and the same arrangement or assignment of colors to these printing stations, as shown in FIG. 3. In this sequence, distances $D_1$ and $D_2$ both equal three repeat lengths so that in the first step the initial region of the carpet is moved so that zones 51 and 53 lie adjacent printing stations 43 and 42, respectively, with zone 52 lying between those stations. Zones 51 and 53 are then printed with color A, after which the carpet is again moved three repeat lengths. Zones 52, 54 and 56 are then printed with color A, after which the carpet is again moved three repeat lengths. As will be seen from the sequence chart in FIG. 4, five repeat lengths in the initial portion of the carpet are printed with all three colors after twelve steps, and six lengths after fourteen steps.

With these examples in mind, certain generalizations can be made about the sequence of the printing operations, which generalizations are valid for the foregoing examples and also for printing techniques employing larger numbers of colors, larger number of printing stations and a similar assignment of colors to printing stations in accordance with the principles described above. In particular, it will be observed that if the total number of printing stations to be employed in the method is represented as P and the number of colors to be printed in the repetitive pattern is indicated as small n, then the number of printing stations per color N is equal to P/n for maximum productivity with all of the stations printing any one color following one another in sequence. More generally, the number N of stations for printing each color can be equal to or less than the ratio P/n but this does not employ the apparatus to its maximum capacity.

With this arrangement, the distances $D_1$ and $D_2$ are then determined so that $D_1+D_2=2N$, $D_1$ and $D_2$ both being odd numbers. The following table sets forth various arrangements of color selections and distances, illustrating the foregoing relationship.

TABLE 1

| P | n | N | 2N | $D_1$ | $D_2$ |
|---|---|---|---|---|---|
| 8 | 4 | 2 | 4 | 3 | 1 |
| 10 | 5 | 2 | 4 | 3 | 1 |
| 12 | 6 | 2 | 4 | 3 | 1 |
| 9 | 3 | 3 | 6 | 5 | 1 |
| 9 | 3 | 3 | 6 | 3 | 3 |
| 12 | 4 | 3 | 6 | 5 | 1 |
| 12 | 4 | 3 | 6 | 3 | 3 |
| 15 | 5 | 3 | 6 | 5 | 1 |
| 15 | 5 | 3 | 6 | 3 | 3 |
| 16 | 4 | 4 | 8 | 7 | 1 |
| 16 | 4 | 4 | 8 | 5 | 3 |
| 20 | 5 | 4 | 8 | 7 | 1 |
| 20 | 5 | 4 | 8 | 5 | 3 |
| 20 | 4 | 5 | 10 | 9 | 1 |
| 20 | 4 | 5 | 10 | 7 | 3 |
| 20 | 4 | 5 | 10 | 5 | 5 |
| 40 | 8 | 5 | 10 | 9 | 1 |

It will be observed that in the performance of this method, the carpet emerging from the output end of the printing portion of the apparatus is not moving at a constant rate whenever a technique is used in which $D_1$ does not equal $D_2$. Normally, this would present problems with the steaming and other equipment following the printing operations, since such equipment is normally designed to operate at a relatively constant speed. However, this difficulty can be overcome simply by permitting the carpet to have slack between the output end of the printer and the input portions of the subsequent equipment, or by employing a series of movable rollers such that the carpet is caused to follow a sinuous path, the rollers at the lower portion thereof being weighted but being capable of vertical movement to accomplish the same task as leaving a draped or slack portion of the carpet.

An integral aspect of the method as described hereinabove is that the stations designated to print each color follow each other in sequence. It will be recognized that other permutations of color assignment could be employed in a printing system in which more than one station is used to print a single color. For example, in a system using nine stations to print three colors the color sequence of successive stations could be ABC, ABC, ABC. While such an arrangement is workable and does have the desirable effect of increasing productivity, the sequence of distances is somewhat more complex and does not result in as simple a relationship as that described above. It is, therefore, somewhat more difficult to derive and implement and is no more advantageous than that described above.

The following table provides examples of stepping sequences for a few combinations of total number of printing stations and numbers of colors, the third column in Table 2 being the sequence of movements of the web between printing operations.

TABLE 2

| P | n | Increment Sequence |
|---|---|---|
| 6 | 3 | 1, 1, 1, 1, 1, 1, 7 |
| 4 | 2 | 1, 1, 1, 5 |
| 6 | 2 | 1, 1, 1, 9 |
| 9 | 3 | 1, 1, 1, 1, 1, 16 |

To further explain Table 2, it will be seen that in the example of six printing stations printing three colors, two stations are used for each color. With the stations being assigned colors in the sequence ABCABC, the sequence of incremental movements between printing steps is one repeat length between each of the first six printing operations, followed by an incremental movement of a distance equal to seven repeat lengths. This pattern of movements is repeated. Similarly, with four printing stations and two colors, the color sequence being ABAB, the first three incremental movements are one repeat length each, followed by an incremental movement of five repeat lengths.

As will be seen from the example of nine printing stations and three colors, as the total number of printing stations increases and the number of colors increases, the difference between incremental distances needed becomes rather large.

While certain advantageous embodiments have been chosen to illustrate the invention, it will be understood by those skilled in the art that various changes and modifications can be made therein without departing from the scope of the invention as defined in the appended claims.

What is claimed is:

1. A method of printing a repetitive multicolor pattern on a long continuous fabric web using a printing apparatus of a type having means for longitudinally moving the web through the machine in increments and for stopping the web for printing between incremental movements, and having a plurality of printing stations operable to print a portion of the pattern on the web while the web is stopped, each station being adapted to print in a single color; the stations being uniformly spaced apart by distances equal to the longitudinal repeat length of each pattern, the method comprising selecting the total number P of printing stations and the number N of stations for printing each color so that $N=P/n$. where n is the number of different colors to be printed in the pattern;

arranging the colors assigned to the printing stations so that all stations for printing the same color follow one another in sequence, the number of stations for each color being greater than 1;

moving the fabric longitudinally for a distance $D_1$ between two successive printing operations and for a distance $D_2$ between the next two successive printing operations where $D_1$ and $D_2$ are each equal to integral odd numbers of pattern repeat lengths and $D_1+D_2=2N$, wherein N is an odd number and $D_1=D_2=N$.

* * * * *